US008225630B1

(12) United States Patent
Chen et al.

(10) Patent No.: US 8,225,630 B1
(45) Date of Patent: Jul. 24, 2012

(54) DUAL-FUNCTION PADLOCK

(75) Inventors: Cheng-jung Chen, Changhua (TW); Yi-wei Chen, Changhua (TW); Yi-ling Chen, Changhua (TW)

(73) Assignee: Glox Industry Co., Ltd., Changhua (TW)

( * ) Notice: Subject to any disclaimer, the term of this patent is extended or adjusted under 35 U.S.C. 154(b) by 0 days.

(21) Appl. No.: 13/154,466

(22) Filed: Jun. 7, 2011

(51) Int. Cl.
*E05B 37/02* (2006.01)

(52) U.S. Cl. ..... 70/21; 70/25; 70/38 C; 70/284; 70/285

(58) Field of Classification Search ..... 70/21, 25, 70/26, 38 R, 38 C, 284, 285, DIG. 63, DIG. 71
See application file for complete search history.

(56) References Cited

U.S. PATENT DOCUMENTS

| | | | | |
|---|---|---|---|---|
| 5,715,709 | A * | 2/1998 | Lai | 70/25 |
| 6,029,481 | A * | 2/2000 | Lai | 70/25 |
| 6,539,761 | B2 * | 4/2003 | Yang | 70/284 |
| 6,792,778 | B1 * | 9/2004 | Chen | 70/21 |
| 6,997,023 | B1 * | 2/2006 | Huang | 70/21 |
| 7,131,299 | B1 * | 11/2006 | Huang | 70/21 |
| 7,216,517 | B2 * | 5/2007 | Ling et al. | 70/21 |
| 7,222,506 | B2 * | 5/2007 | Yu | 70/21 |
| 7,251,965 | B2 * | 8/2007 | Yu | 70/21 |
| 7,552,607 | B2 * | 6/2009 | Yang | 70/21 |
| 2006/0225469 | A1 * | 10/2006 | Yu | 70/21 |
| 2008/0011026 | A1 * | 1/2008 | Huang | 70/21 |
| 2008/0098774 | A1 * | 5/2008 | Huang | 70/21 |
| 2009/0229329 | A1 * | 9/2009 | Star | 70/284 |

* cited by examiner

*Primary Examiner* — Lloyd Gall

(57) ABSTRACT

A dual-function padlock includes a lock body, a numeral detent unit, a U-shaped hook, a hook member, a numeral unlocking member, and a lock core unit, providing a simple configuration. By an operation portion of a numeral unlocking member, the padlock can be unlocked by using numerals and can be conveniently locked without the need to match correct numerals.

5 Claims, 9 Drawing Sheets

DUAL-FUNCTION PADLOCK

BACKGROUND OF THE INVENTION

1. Field of the Invention

The present invention relates to a dual-function padlock, and more particularly to a padlock which can be unlocked by numerals or a key and can be locked without the need to match correct numerals.

2. Description of the Prior Art

A U-shaped padlock is used to lock a luggage. In particular, a U-shaped numeral padlock is popular because it doesn't need a key, which is very convenient for travel. Nowadays, most countries are strict with travelers for the check of safety because of counter-strike and some countries require certified unlocking systems of padlocks, preventing the numeral padlock from being damaged. The certified padlock producers have to use common lock cores in the padlocks, so that the safety examiners can unlock a certified numeral padlock of a luggage by using a common key for examination.

A conventional U-shaped padlock, such as U.S. Pat. No. 5,715,709, only uses dials to unlock the padlock. The longitudinal axle of the shackle extends through the dials disposed in the dials channels of the lock body, so the rotatable cylinder provided on the axle of the shackle can be moved in and out of the alveolus at the central portion of the dials along with the axial movement of the axle of the shackle. A block is used to restrain the axle of the shackle from being out of the core hole of the lock body. In the axial movement space of the restrained axle of the shackle, the rotatable cylinder has an engaging tooth to be inserted in the alveolus at the central portion of the dials, and the core hole of the lock body has a tooth groove corresponding to the engaging tooth. The dials are turned to align the engaging tooth of the rotatable cylinder with the tooth groove, such that the engaging tooth can be moved in the tooth groove. After that, the axle of the shackle can be pulled outward and the hook end can disengage from the lock hole so as to unlock the padlock. When the numerals of the dials are not correct, the engaging tooth cannot be engaged in the tooth groove and the axle cannot be axially pulled to be in a locked status.

In fact, the conventional U-shaped key padlock and U-shaped numeral padlock are two different types of lock structures. It is somewhat difficult to combine the functions of the two padlocks. The simpler the structure is, the more difficult the technique is. Accordingly, the inventor of the present invention has devoted himself based on his many years of practical experiences to solve this problem that the padlock requires numerals to unlock and that the padlock can be locked without the need of correct numerals.

SUMMARY OF THE INVENTION

The primary object of the present invention is to provide a dual-function padlock which comprises a lock body, a numeral detent unit, a U-shaped hook, a hook member, a numeral unlocking member, and a lock core unit.

The lock body comprises a lock housing and a cover which are coupled to each other, and has an accommodation chamber, a hook hole in front of the accommodation chamber, a mounting trough beside the chamber, a swing chamber in front of the mounting trough, a pivot in the swing chamber, an operation trough beside the swing chamber and a receiving hole in front of the swing chamber.

The numeral detent unit is located in the accommodation chamber of the lock body, and comprises a rod, a plurality of tumbler sleeves on the rod, a plurality of numeral wheels which are located on the respective tumbler sleeves and exposed out of the lock body, a detent portion at one end of the rod, a first spring which is located on the rod and against an inner side of the detent portion and the tumbler sleeves.

The U-shaped hook has a revolving rod at one end thereof and a hook portion at another end thereof. The hook portion is to be inserted in the hook hole of the lock body. The revolving rod is located in the receiving hole of the lock body, and has an annular groove thereon.

The hook member has a pivot hole at a central portion thereof for insertion of the pivot in the swing chamber of the lock body. The hook member further has a push portion and a catch portion at two ends thereof. One end of the push portion is biased by a second spring, so that the catch portion is normally engaged in the annular groove of the U-shaped hook to restrain the hook portion of the U-shaped hook from disengaging from the hook hole of the lock body.

The numeral unlocking member is overlapped on the hook member, and has a through hole at a central portion thereof for insertion of the pivot in the swing chamber of the lock body. The numeral unlocking member further has a press portion and an operation portion at two ends thereof. The press portion is against the detent portion of the numeral detent unit. The operation portion is exposed out of the operation trough of the lock body. The numeral unlocking member further has a bottom protrusion between the press portion and the operation portion. The bottom protrusion corresponds in position to the catch portion of the hook member and is used to push the hook member.

The lock core unit is located in the mounting trough of the lock body. The lock core unit has a key hole which is exposed out of the lock body and a spindle which is driven to push the push portion so as to swing the hook member when a key is inserted in the key hole.

When the numeral wheels of the numeral detent unit are turned to correct numerals, the detent portion won't block the press portion of the numeral unlocking member from pushing the rod downward. The operation portion of the numeral unlocking member is pressed inward, such that the catch portion of the hook member is driven by the bottom protrusion of the numeral unlocking member to disengage from the annular groove of the U-shaped hook and the hook portion disengages from the hook hole to unlock the padlock. When the operation portion of the numeral unlocking member is pushed inward, the first spring on the rod of the numeral detent unit will urge the detent portion and the press portion of the numeral unlocking member back, so that the operation portion is returned to its original position and the U-shaped hook is still in an unlocked status. No matter what the numeral wheels of the numeral detent unit are turned correctly or wrongly, the U-shaped hook can be engaged in the hook hole again. The push portion of the hook member is biased by the second spring to push the catch portion to engage with the annular groove of the U-shaped hook again. The padlock is locked again. When the user wants to use the key to unlock the padlock, the key is inserted in the key hole of the lock core unit to turn the spindle, such that the push portion of the hook member is driven by the spindle to swing the hook member and then the catch portion is disengaged from the annular groove of the U-shaped hook, and the hook portion is disengaged from the hook hole to unlock the padlock. When the key is returned back and pulled out, the U-shaped hook is still remained in an unlocked status. The hook portion of the U-shaped hook can be operated to engage in the hook hole to lock the padlock again, without using the key. The configuration of the present invention is simple. The operation portion of the numeral unlocking member is disposed out of the lock body, which is convenient for operation. The padlock can be locked without the need of correct numerals. This enhances the convenience to lock the padlock.

Preferably, the revolving rod of the U-shaped hook is located in the receiving hole of the lock body. The revolving rod further has at least one stop portion protruding outward. A third spring is provided in the receiving hole. The third spring is fitted on the revolving rod and compressed by the stop portion. When the catch portion of the hook member is disengaged from the annular groove of the U-shaped hook, the revolving rod of the U-shaped hook will be pushed outward by the third spring against the stop portion, so that the hook portion is pushed to disengage from the hook hole so as to unlock the padlock.

Preferably, the catch portion of the hook member is engaged in the annular groove of the U-shaped hook. The catch portion has a U-shaped engaging opening to be engaged with the annular groove so as to confine the hook portion of the U-shaped hook in the hook hole, providing a better lock effect.

Preferably, the operation portion of the numeral unlocking member is exposed out of the operation trough of the lock body, so the operation portion forms a closed arc button. When the numerals of the numeral wheels of the numeral detent unit are correct, the user can press the operation portion inward with one single hand to unlock the padlock. This is very convenient to unlock the padlock with one hand. Preferably, the spindle of the lock core unit extends to one side of the press portion of the hook member. The spindle is a semicircle rod and has a flat surface to attach to the press portion of the hook member. When the key is inserted in the key hole to turn the spindle, the flat surface is turned 90 degrees to be away from the press portion, and the press portion is pushed by an outer edge of the spindle to disengage the catch portion from the annular groove of the U-shaped hook, so the key can unlock the padlock with ease.

DETAILED DESCRIPTION OF THE PREFERRED EMBODIMENTS

Embodiments of the present invention will now be described, by way of example only, with reference to the accompanying drawings.

Figure 1:
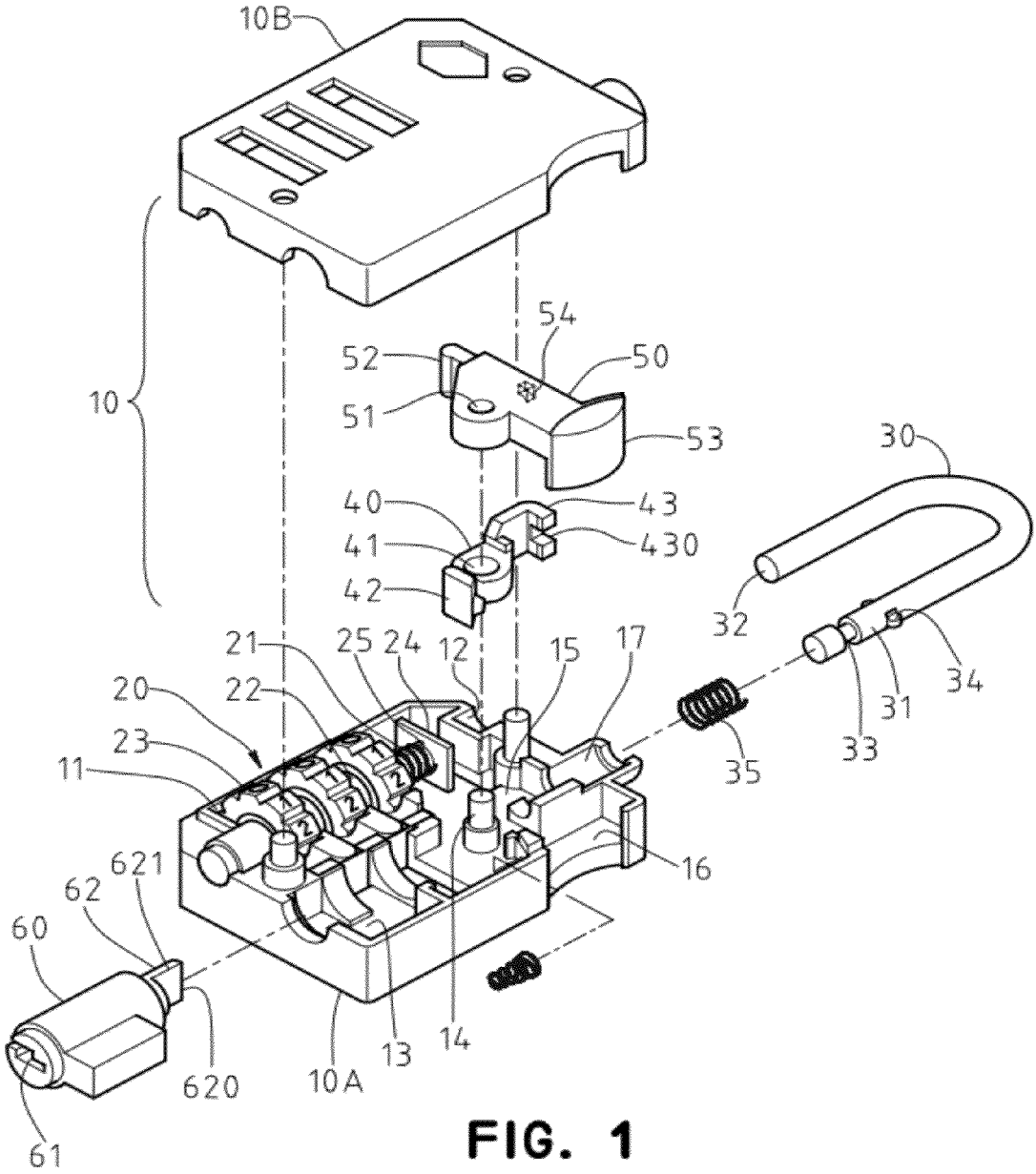
FIG. 1 is an exploded view according to a preferred embodiment of the present invention.
Figure 2:
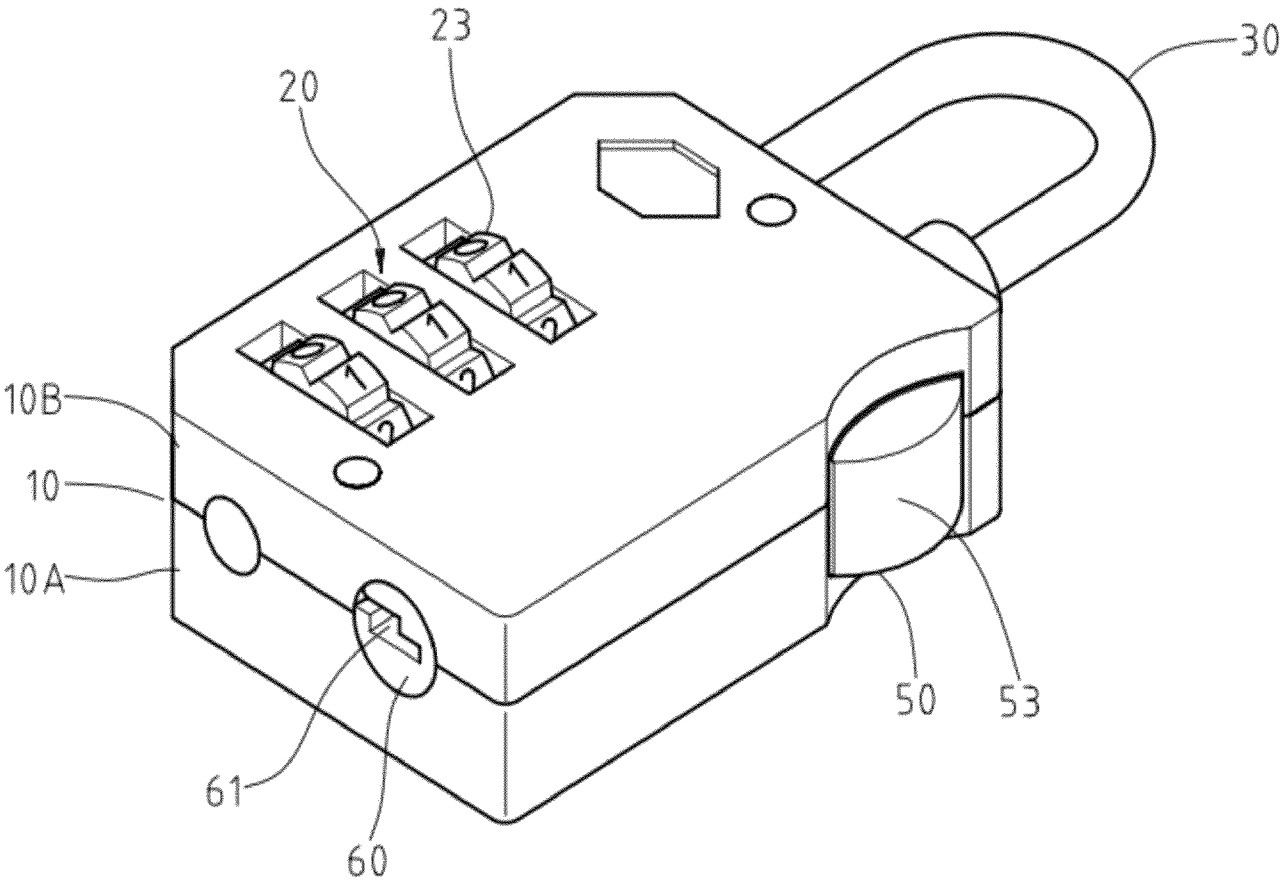
FIG. 2 is a perspective view according to the preferred embodiment of the present invention.
Figure 3:
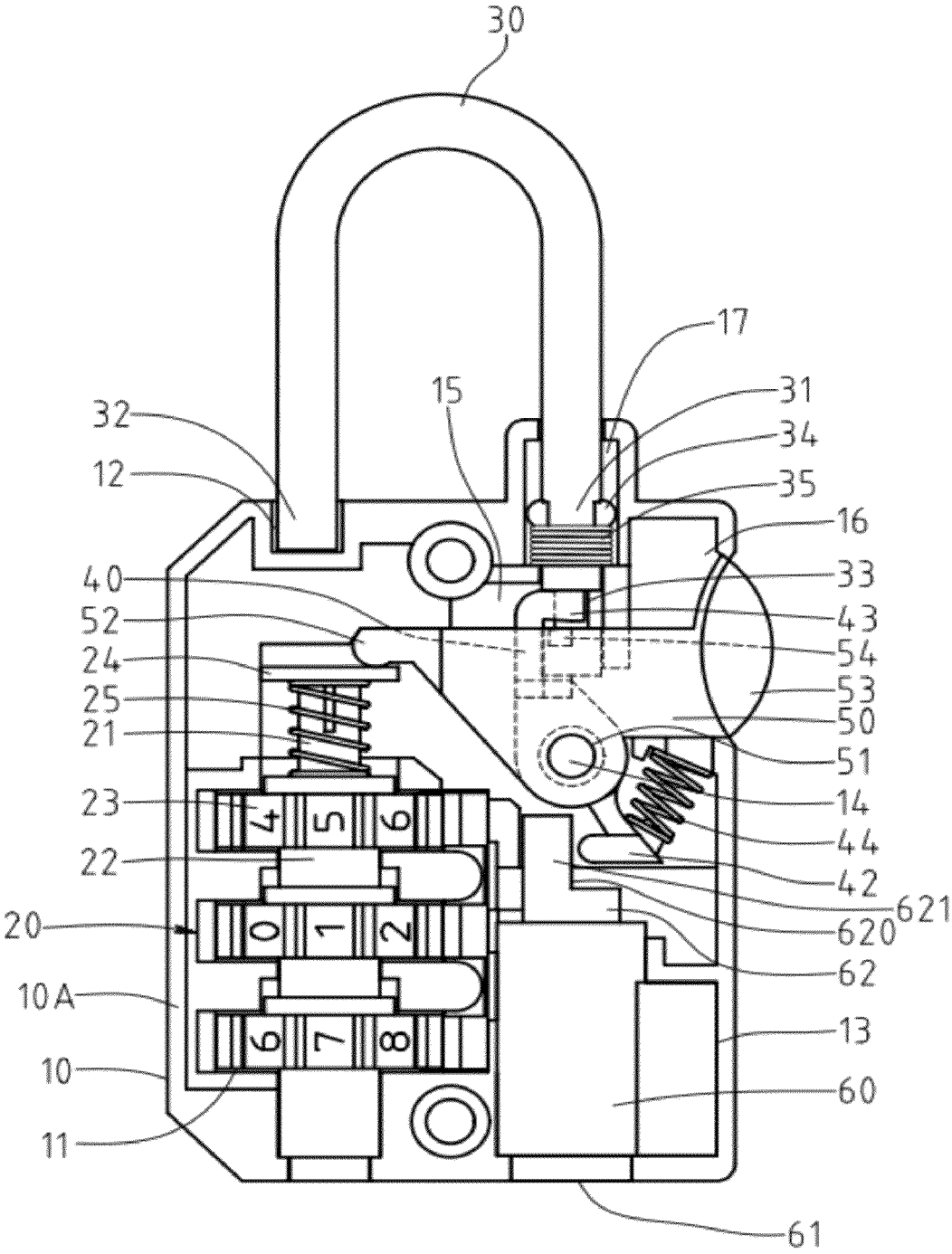
FIG. 3 is a top view showing the inner configuration of the padlock according to the preferred embodiment of the present invention.

As shown in FIG. 1, FIG. 2 and FIG. 3, a dual-function padlock according to a preferred embodiment of the present invention comprises a lock body 10, a numeral detent unit 20, a U-shaped hook 30, a hook member 40, a numeral unlocking member 50, and a lock core unit 60.

The lock body 10 comprises a lock housing 10A and a cover 10B which are coupled to each other, and has an accommodation chamber 11, a hook hole 12 in front of the accommodation chamber 11, a mounting trough 13 beside the chamber 11, a swing chamber 15 in front of the mounting trough 13, a pivot 14 in the swing chamber 15, an operation trough 16 beside the swing chamber 15, and a receiving hole 17 in front of the swing chamber 15.

The numeral detent unit 20 is located in the accommodation chamber 11 of the lock body 10, and comprises a rod 21, a plurality of tumbler sleeves 22 on the rod 21, a plurality of numeral wheels 23 which are located on the respective tumbler sleeves 22 and exposed out of the lock body 10, a detent portion 24 at one end of the rod 21, a first spring 25 which is located on the rod 21 and against an inner side of the detent portion 24 and the tumbler sleeves 22.

The U-shaped hook 30 has a revolving rod 31 at one end thereof and a hook portion 32 at another end thereof. The hook portion 32 is to be inserted in the hook hole 12 of the lock body 10. The revolving rod 31 is located in the receiving hole 17 of the lock body 10, and has an annular groove 33 thereon.

The hook member 40 has a pivot hole 41 at a central portion thereof for insertion of the pivot 14 in the swing chamber 15 of the lock body 10. The hook member 40 further has a push portion 42 and a catch portion 43 at two ends thereof. One end of the push portion 42 is biased by a second spring 44, so that the catch portion 43 is normally engaged in the annular groove 33 of the U-shaped hook 30 to restrain the hook portion 32 of the U-shaped hook 30 from disengaging from the hook hole 12 of the lock body 10.

The numeral unlocking member 50 is overlapped on the hook member 40, and has a through hole 51 at a central portion thereof for insertion of the pivot 14 in the swing chamber 15 of the lock body 10. The numeral unlocking member 50 further has a press portion 52 and an operation portion 53 at two ends thereof. The press portion 52 is against the detent portion 24 of the numeral detent unit 20. The operation portion 53 is exposed out of the operation trough 16 of the lock body 10. The numeral unlocking member 50 further has a bottom protrusion 54 between the press portion 52 and the operation portion 53. The bottom protrusion 54 corresponds in position to the catch portion 43 of the hook member 40 and is used to push the hook member 40.

The lock core unit 60 is located in the mounting trough 13 of the lock body 10. The lock core unit 60 has a key hole 61 which is exposed out of the lock body 10 and a spindle 62 which is driven to push the push portion 42 so as to swing the hook member 40 when a key is inserted in the key hole 61.

Figure 4:
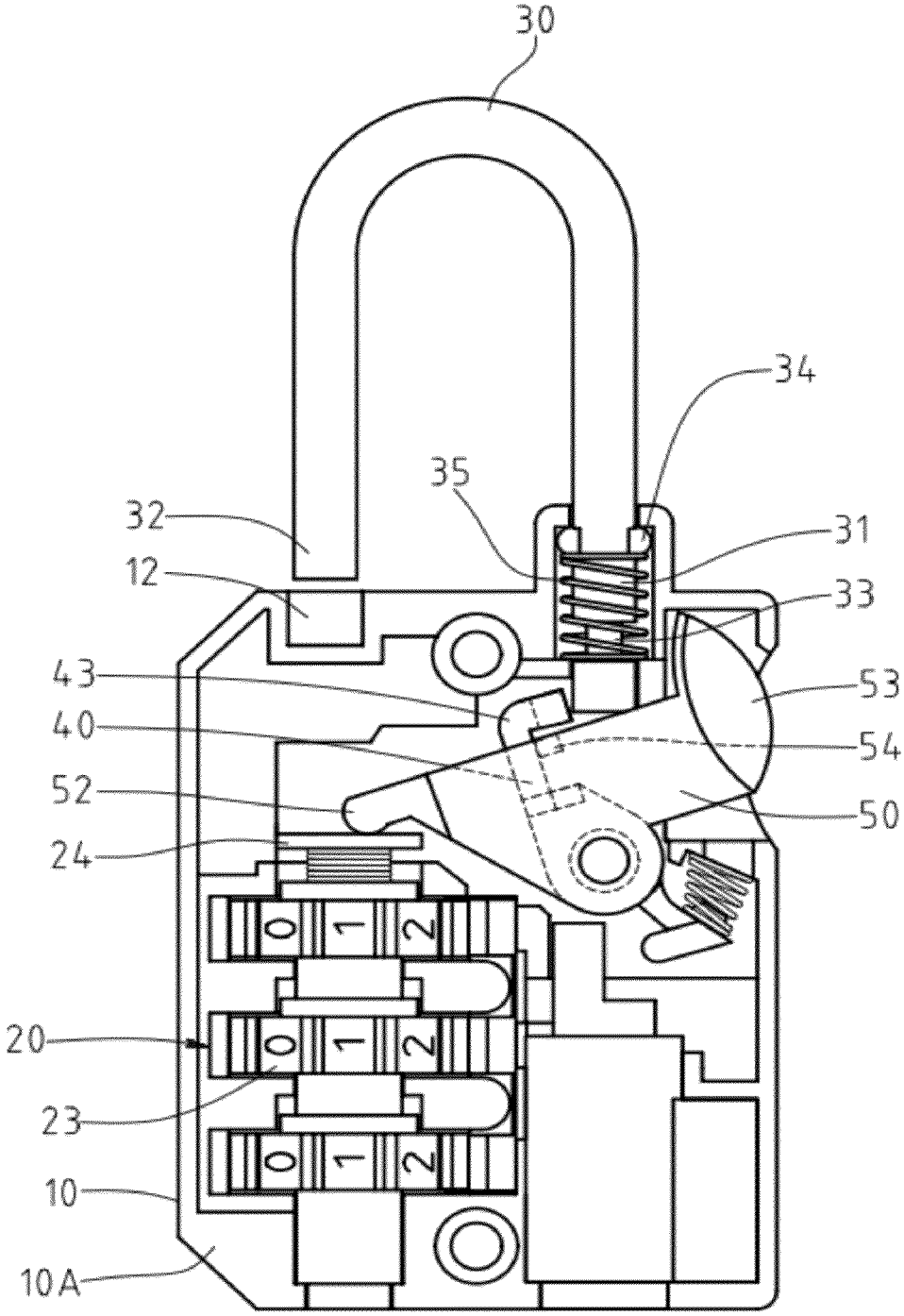
FIG. 4 is a schematic view showing the padlock in an unlocking status by means of numerals according to the preferred embodiment of the present invention.
Figure 5:
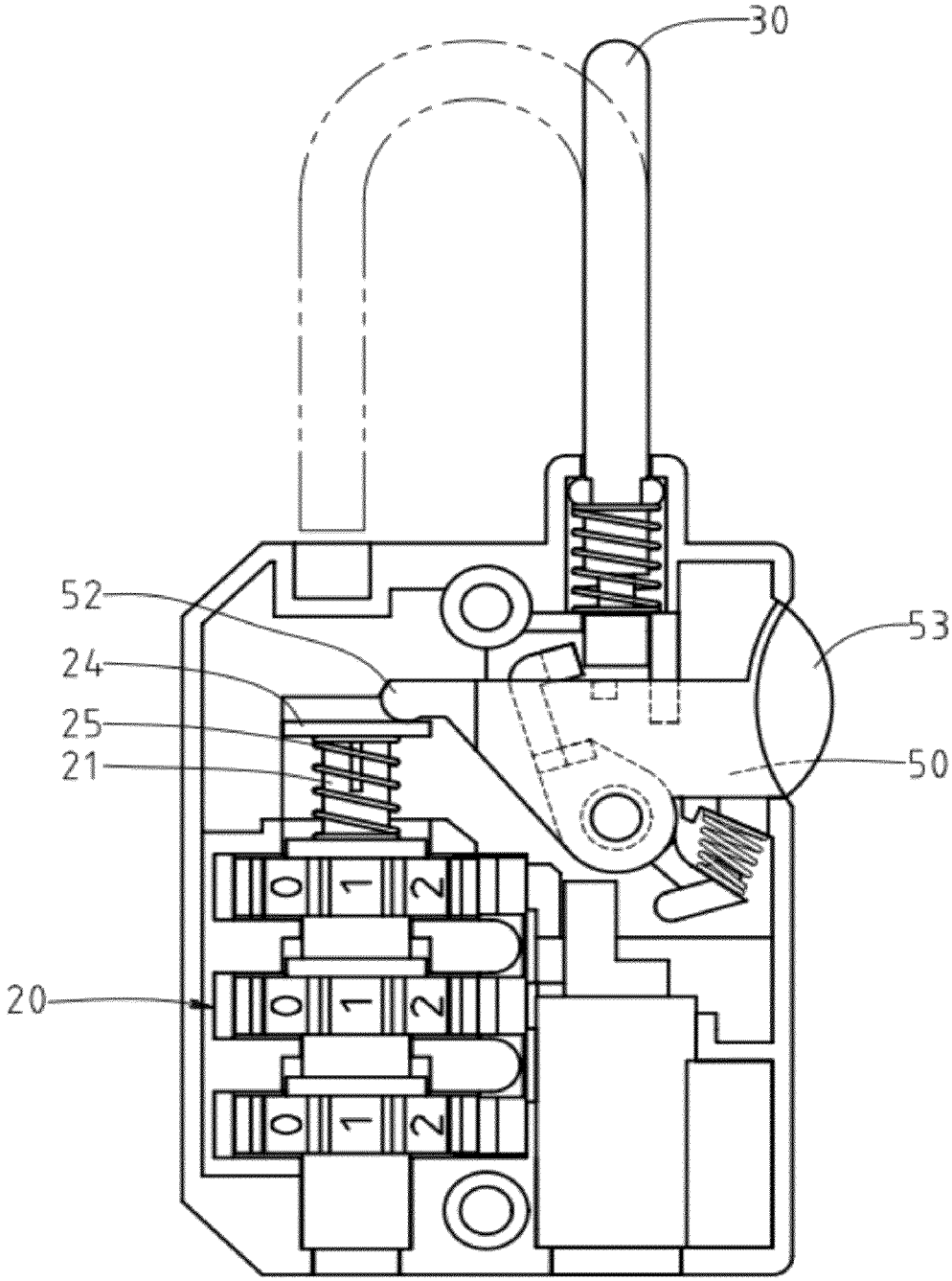
FIG. 5 is a schematic view showing the padlock in an unlocked status by means of numerals according to the preferred embodiment of the present invention.
Figure 6:
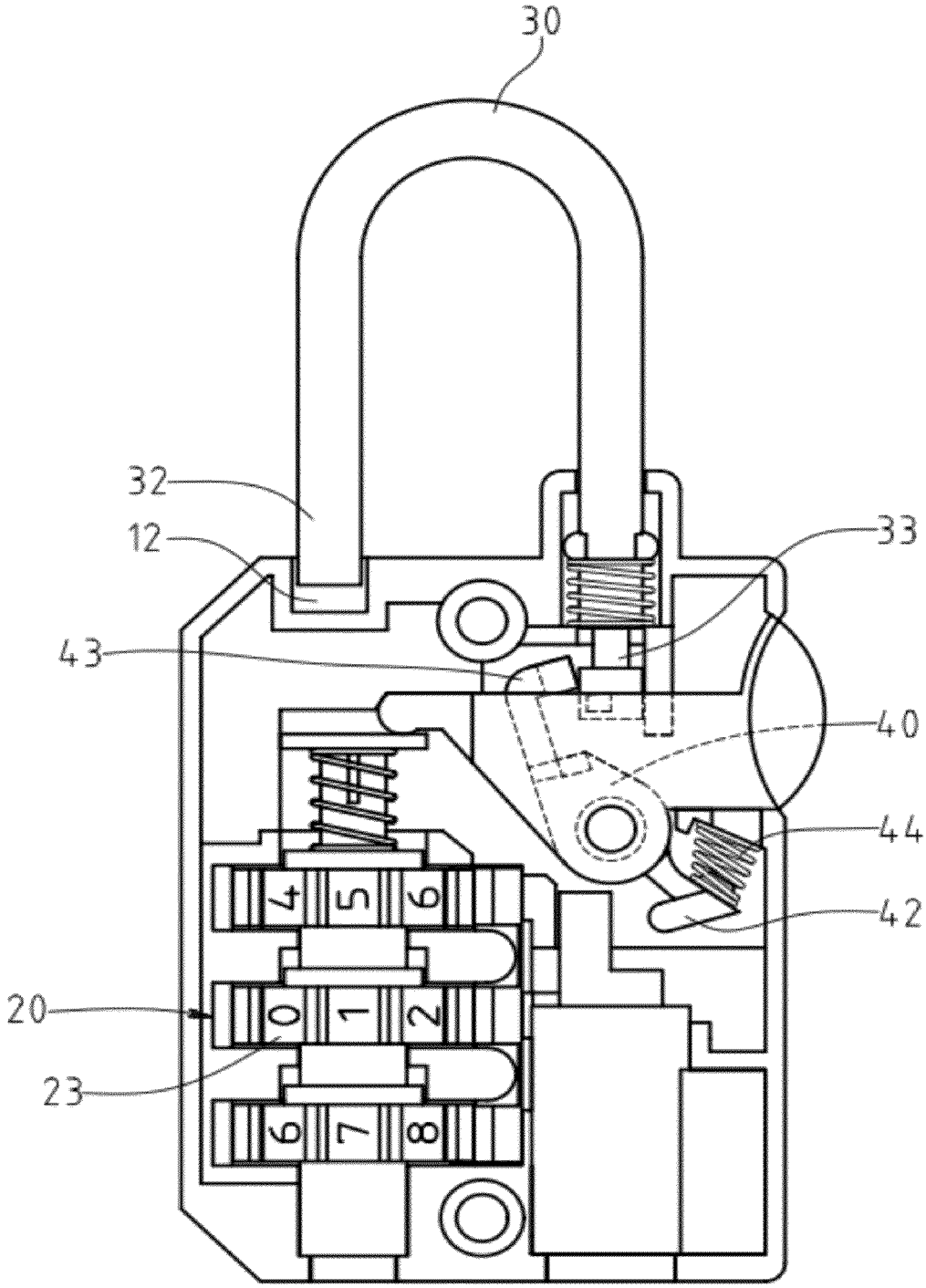
FIG. 6 is a schematic view showing the padlock to be locked when the numerals are not correct according to the preferred embodiment of the present invention.
Figure 7:
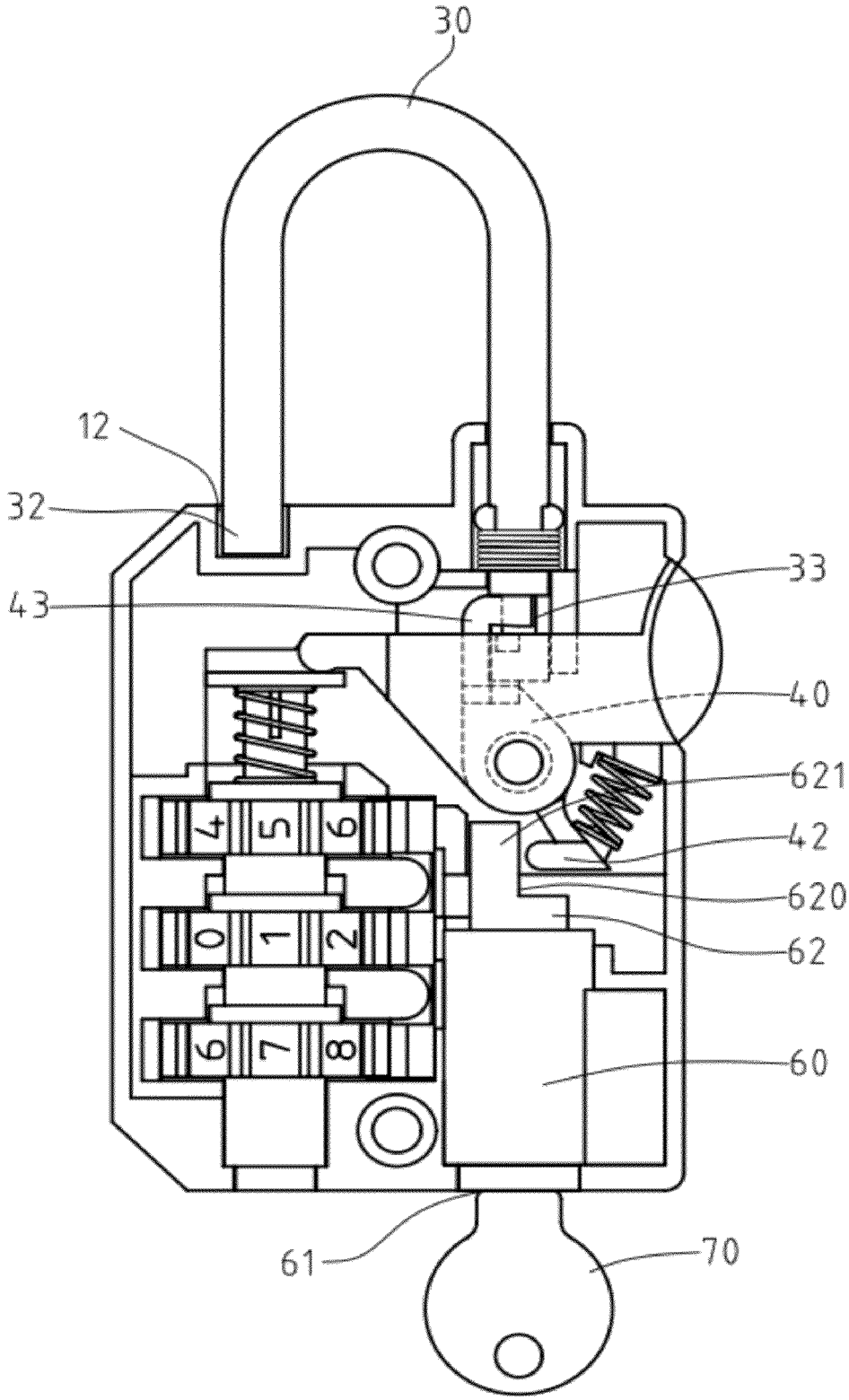
FIG. 7 is a schematic view showing the padlock not being unlocked by means of the key according to the preferred embodiment of the present invention.
Figure 8:
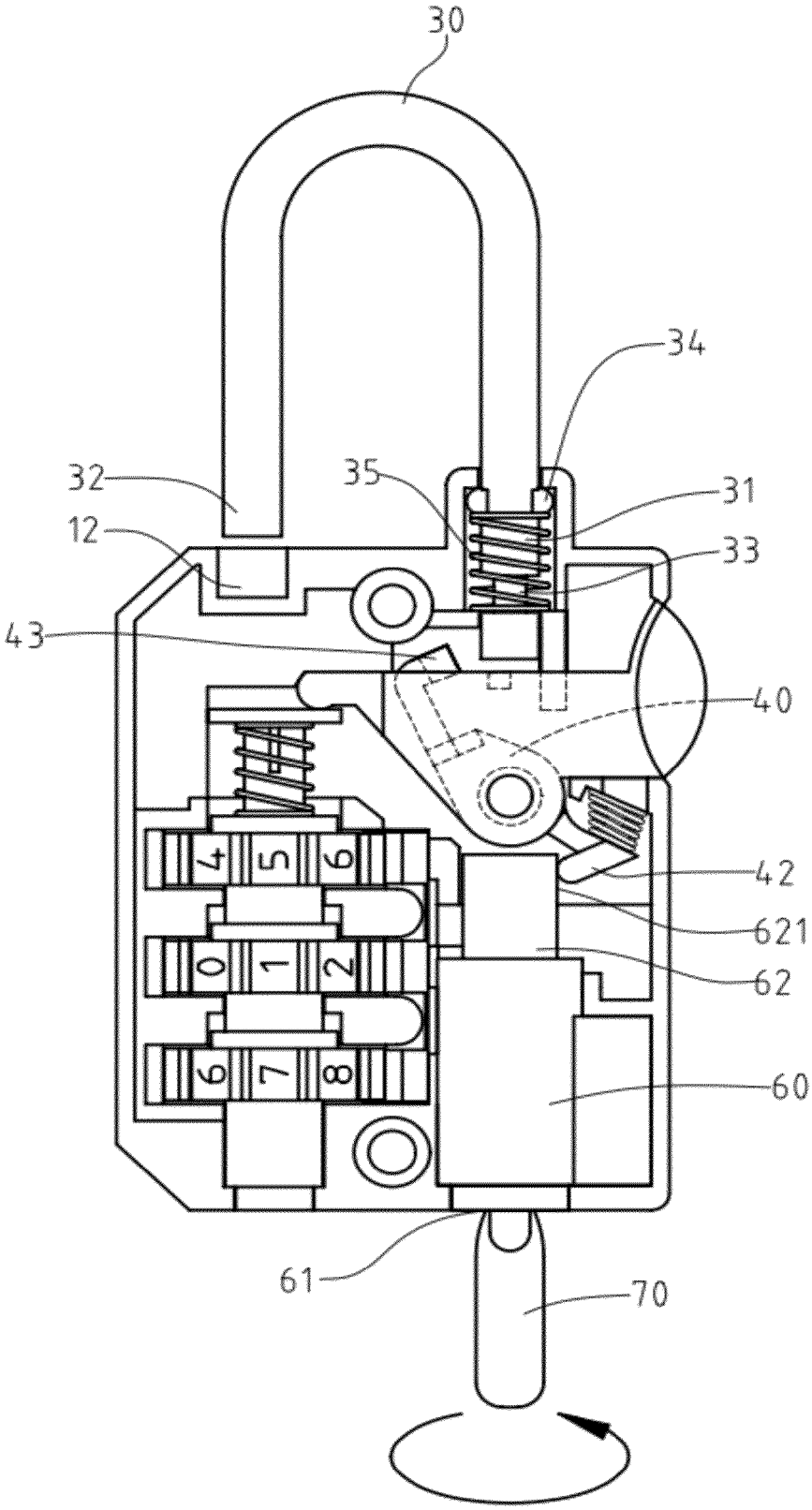
FIG. 8 is a schematic view showing the padlock in an unlocking status by means of the key according to the preferred embodiment of the present invention.
Figure 9:
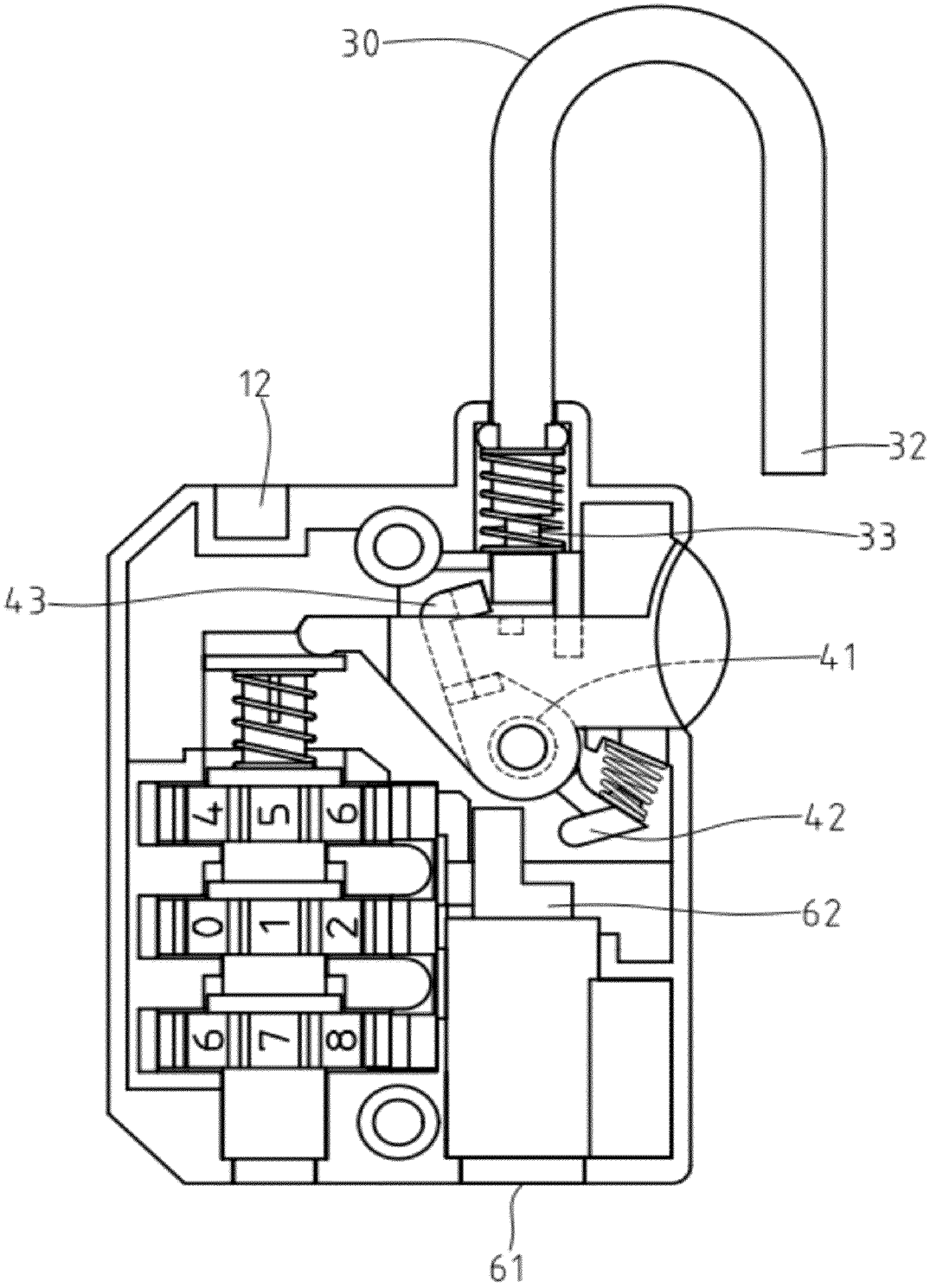
FIG. 9 is a schematic view showing the padlock in an unlocked status by means of the key according to the preferred embodiment of the present invention.

As shown in FIG. 3 and FIG. 4, when the numeral wheels 23 of the numeral detent unit 20 are turned to correct numerals, the detent portion 24 won't block the press portion 52 of the numeral unlocking member 50 from pushing the rod 21 downward. The operation portion 53 of the numeral unlocking member 50 is pressed inward, such that the catch portion 43 of the hook member 40 is driven by the bottom protrusion 54 of the numeral unlocking member 50 to disengage from the annular groove 33 of the U-shaped hook 30 and the hook portion 32 disengages from the hook hole 12 to unlock the padlock. As shown in FIG. 5, when the operation portion 53 of the numeral unlocking member 50 is pushed inward, the first spring 25 on the rod 21 of the numeral detent unit 20 will urge the detent portion 24 and the press portion 52 of the numeral unlocking member 50 back, so that the operation portion 53 is returned to its original position and the U-shaped hook 30 is still in an unlocked status. As shown in FIG. 6, no matter what the numeral wheels 23 of the numeral detent unit 20 are turned correctly or wrongly, the U-shaped hook 30 can be engaged in the hook hole 12 again. As shown in FIG. 3 and FIG. 6, the push portion 42 of the hook member 40 is biased by the second spring 44 to push the catch portion 43 to engage with the annular groove 33 of the U-shaped hook 30 again. The padlock is locked again. As shown in FIG. 7 and FIG. 8, when the user wants to use a key 70 to unlock the padlock, the key 70 is inserted in the key hole 61 of the lock core unit 60 to turn the spindle 62, such that the push portion 42 of the hook member 40 is driven by the spindle 62 to swing the hook member 40 and then the catch portion 43 is disengaged from the annular groove 33 of the U-shaped hook 30, and the hook portion 32 is disengaged from the hook hole 12 to unlock the padlock. As shown in FIG. 9, when the key 70 is returned back and pulled out, the U-shaped hook 30 is still remained in an unlocked status. As shown in FIG. 3 and FIG. 6, the hook portion 32 of the U-shaped hook 30 can be operated to engage in the hook hole 12 to lock the padlock again, without using the key 70. The configuration of the present invention is simple. As shown in FIG. 4, the operation portion 53 of the numeral unlocking member 50 is disposed out of the lock body 10, which is convenient for operation. As shown in FIG. 6, the padlock can be locked without the need of correct numerals. This enhances the convenience to lock the padlock.

According to the aforesaid embodiment, as shown in FIG. 1 and FIG. 3, the revolving rod 31 of the U-shaped hook 30 is located in the receiving hole 17 of the lock body 10. The revolving rod 31 further has at least one stop portion 34 protruding outward. A third spring 35 is provided in the receiving hole 17. The third spring 35 is fitted on the revolving rod 31 and compressed by the stop portion 34. As shown in FIG. 4 and FIG. 8, when the catch portion 43 of the hook member 40 is disengaged from the annular groove 33 of the U-shaped hook 30, the revolving rod 31 of the U-shaped hook 30 will be pushed outward by the third spring 35 against the stop portion 34, so that the hook portion 32 is pushed to disengage from the hook hole 12 so as to unlock the padlock.

According to the aforesaid embodiment, as shown in FIG. 1 and FIG. 3, the catch portion 43 of the hook member 40 is engaged in the annular groove 33 of the U-shaped hook 30. The catch portion 43 has a U-shaped engaging opening 430 to be engaged with the annular groove 33 so as to confine the hook portion 32 of the U-shaped hook 30 in the hook hole 12, providing a better lock effect.

According to the aforesaid embodiment, as shown in FIG. 1 and FIG. 3, the operation portion 53 of the numeral unlocking member 50 is exposed out of the operation trough 16 of the lock body 10, so the operation portion 53 forms a closed arc button. When the numerals of the numeral wheels 23 of the numeral detent unit 20 are correct, the user can press the operation portion 53 inward with one single hand to unlock the padlock. This is very convenient to unlock the padlock with one hand.

According to the aforesaid embodiment, as shown in FIG. 1 and FIG. 3, the spindle 62 of the lock core unit 60 extends to one side of the push portion 42 of the hook member 40. The spindle 62 is a semi-circle rod and has a flat surface 620 to not attached to the push portion 42 of the hook member 40. As shown in FIG. 7 and FIG. 8, when the key 70 is inserted in the key hole 61 to turn the spindle 62, the flat surface 620 is turned 90 degrees to be away from the push portion 42, and the push portion 42 is pushed by an outer edge 621 of the spindle 62 to disengage the catch portion 43 from the annular groove 33 of the U-shaped hook 30, so the key 70 can unlock the padlock with ease.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A dual-function padlock, comprising:

a lock body comprising a lock housing and a cover which are coupled to each other, the lock body having an accommodation chamber, a hook hole in front of the accommodation chamber, a mounting trough beside the chamber, a swing chamber in front of the mounting trough, a pivot in the swing chamber, an operation trough beside the swing chamber and a receiving hole in front of the swing chamber;

a numeral detent unit located in the accommodation chamber of the lock body, the numeral detent unit comprising a rod, a plurality of tumbler sleeves on the rod, a plurality of numeral wheels which are located on the respective tumbler sleeves and exposed out of the lock body, a detent portion at one end of the rod, a first spring which is located on the rod and against an inner side of the detent portion and the tumbler sleeves;

a U-shaped hook having a revolving rod at one end thereof and a hook portion at another end thereof, the hook portion being adapted to be inserted in the hook hole of the lock body, the revolving rod being located in the receiving hole of the lock body and having an annular groove thereon;

a hook member having a pivot hole at a central portion thereof for insertion of the pivot in the swing chamber of the lock body, the hook member further having a push portion and a catch portion at two ends thereof, one end of the push portion being biased by a second spring, the catch portion being engaged in the annular groove of the U-shaped hook to restrain the hook portion of the U-shaped hook from disengaging from the hook hole of the lock body;

a numeral unlocking member overlapped on the hook member, the numeral unlocking member having a through hole at a central portion thereof for insertion of the pivot in the swing chamber of the lock body, the numeral unlocking member further having a press portion and an operation portion at two ends thereof, the press portion being against the detent portion of the numeral detent unit, the operation portion being exposed out of the operation trough of the lock body, the numeral unlocking member further having a bottom protrusion between the press portion and the operation portion, the bottom protrusion corresponding in position to the catch portion of the hook member and being used to push the hook member; and a lock core unit located in the mounting trough of the lock body, the lock core unit having a key hole which is exposed out of the lock body and a spindle which is driven to push the push portion so as to swing the hook member when a key is inserted in the key hole;

thereby, when the numeral wheels of the numeral detent unit being turned to correct numerals, the detent portion not blocking the press portion of the numeral unlocking member from pushing the rod downward, the operation portion of the numeral unlocking member being pressed inward, such that the catch portion of the hook member being driven by the bottom protrusion of the numeral unlocking member to disengage from the annular groove of the U-shaped hook and the hook portion disengaging from the hook hole to unlock the padlock, when the operation portion of the numeral unlocking member being pushed inward, the first spring on the rod of the numeral detent unit urging the detent portion and the press portion of the numeral unlocking member back so that the operation portion being returned to its original position and the U-shaped hook being still in an unlocked status, no matter what the numeral wheels of the numeral detent unit being turned correctly or wrongly, the U-shaped hook can be engaged in the hook hole again, the push portion of the hook member being biased by the second spring to push the catch portion to engage with the annular groove of the U-shaped hook again, the padlock being locked again, when the user wants to use the key to unlock the padlock, the key being inserted in the key hole of the lock core unit to turn the spindle, such that the push portion of the hook member being driven by the spindle to swing the hook member and then the catch portion being disengaged from the annular groove of the U-shaped hook and the hook portion being disengaged from the hook hole to unlock the padlock, when the key being returned back and pulled out, the U-shaped hook is still remained in an unlocked status, the hook portion of the U-shaped hook being operated to engage in the hook hole so as to lock the padlock again, without using the key, the operation portion of the numeral unlocking member being disposed out of the lock body for convenient operation.

2. The dual-function padlock as claimed in claim 1, wherein the revolving rod of the U-shaped hook is located in the receiving hole of the lock body, the revolving rod further has at least one stop portion protruding outward, a third spring is provided in the receiving hole, the third spring is fitted on the revolving rod and compressed by the stop portion, when the catch portion of the hook member is disengaged from the annular groove of the U-shaped hook, the revolving rod of the U-shaped hook is pushed outward by the third spring against the stop portion, so that the hook portion is pushed to disengage from the hook hole so as to unlock the padlock.

3. The dual-function padlock as claimed in claim 1, wherein the catch portion of the hook member is engaged in the annular groove of the U-shaped hook, the catch portion has a U-shaped engaging opening to be engaged with the annular groove so as to confine the hook portion of the U-shaped hook in the hook hole.

4. The dual-function padlock as claimed in claim 1, wherein the operation portion of the numeral unlocking member is exposed out of the operation trough of the lock body, the operation portion forms a closed arc button, when the numerals of the numeral wheels of the numeral detent unit are correct, the user can press the operation portion inward with one single hand to unlock the padlock.

5. The dual-function padlock as claimed in claim 1, wherein the spindle of the lock core unit extends to one side of the push portion of the hook member, the spindle is a semi-circle rod and has a flat surface not attached to the push portion of the hook member, when the key is inserted in the key hole to turn the spindle, the flat surface is turned 90 degrees to be away from the push portion, and the push portion is pushed by an outer edge of the spindle to disengage the catch portion from the annular groove of the U-shaped hook.

* * * * *